United States Patent [19]

Lotté et al.

[11] 4,216,888

[45] Aug. 12, 1980

[54] INSTALLATION FOR THE FORMATION OF SUSPENDED FOLDS IN TEXTILE STRIP MATERIAL

[75] Inventors: Andre Lotté, Amiens; Raymond Gross, Mulhouse, both of France

[73] Assignee: Societe Alsacienne de Constructions Mecaniques de Mulhouse, Mulhouse, France

[21] Appl. No.: 7,934

[22] Filed: Jan. 31, 1979

[30] Foreign Application Priority Data

Feb. 8, 1978 [FR] France ..... 78 03472

[51] Int. Cl.[2] ..... B65H 17/42

[52] U.S. Cl. ..... 226/104; 34/157; 68/5 D; 226/97; 226/106

[58] Field of Search ..... 226/104, 105, 106, 107, 226/95, 97; 68/5 D, 5 E; 34/157

[56] References Cited

U.S. PATENT DOCUMENTS

| | | | |
|---|---|---|---|
| 1,287,172 | 12/1918 | Andrews | 226/106 X |
| 2,534,026 | 12/1950 | Hurxthal | 226/106 X |
| 2,788,968 | 4/1957 | Parkes | 226/106 X |
| 3,147,899 | 9/1964 | Parkes | 226/106 |

*Primary Examiner*—Stanley N. Gilreath

*Attorney, Agent, or Firm*—Cantor and Singer

[57] ABSTRACT

In an installation comprising a chain of rods from which woven material in strip form is suspended in folds, the discharge of hot air or steam through a blowing nozzle is subjected to the cyclic action of a regulating device for progressively reducing the nozzle discharge from a predetermined maximum value during commencement of formation of a fold to a zero value after only a fraction of the time required for complete formation has elapsed. The installation is primarily intended for use in steaming machines.

9 Claims, 11 Drawing Figures

IV
IV
47(45)
47B(45B)
53
54
45
47
46
31
51
f2
47C
47(46)
45(46)
21
47(45,46)
45A
46A
46B
47A
D
Dmaxi
100%
85%
65%
0%
T
T2
0
1/8
1/4
3/8
1/2
5/8
3/4
7/8
1

INSTALLATION FOR THE FORMATION OF SUSPENDED FOLDS IN TEXTILE STRIP MATERIAL

This invention relates to installations for the formation of suspended folds of textile material in strip form. An installation of this type is intended to be employed in steaming machines and comprises a chain of rods constituted by a strand which is intended to move horizontally at a low speed. At the upstream end of the chain of rods, a strip of textile material is deposited continuously at a much higher rate than the rate of travel of said chain of rods so as to form suspended folds of material between said rods. At the same time, a stationary blowing nozzle directs a jet of steam or hot air onto said upstream end of the above-mentioned chain of rods in order to initiate the formation of each fold between two successive rods of the chain.

In known installations of this type, the discharge of hot air or steam which is blown onto the material by the nozzle is constant. However, this is subject to disadvantages. In point of fact, when the fold of material begins to reach a certain depth, a kind of pocket is formed under the blowing action, becomes inflated to a certain extent and comes into contact with the fold of material which has previously been formed. In consequence, the dye which is printed on the fold which is being formed partially stains the fold which has already been formed.

The aim of the invention is to improve conventional fold-forming installations with a view to overcoming the disadvantages mentioned in the foregoing.

To this end, the installation in accordance with the invention comprises a device for cyclic regulation of the discharge of hot air or steam blown through the nozzle. By means of said regulating device, the nozzle discharge can be progressively reduced from a predetermined maximum value during commencement of formation of a fold to a zero value after only a fraction of the time required for the formation of a complete fold has elapsed.

The above-mentioned device for modulating the discharge of hot air which is blown through the nozzle is so designed that, as soon as each fold has in turn reached a sufficient depth to become stabilized, the air discharge is progressively reduced to a zero value. The fold is consequently no longer liable to be inflated by the stream of hot air and to come into contact with the preceding fold.

In an advantageous embodiment, the device for cyclic regulation of the blowing nozzle discharge comprises a movable shutter which is interposed in the fluid circuit for the supply of hot air or steam to the nozzle. Said shutter is connected to a roller which is in contact with a cam carried by a rotary shaft, said shaft being coupled to the mechanism for producing the displacement of the chain of rods by means of a belt-drive system having a velocity ratio such that said cam shaft performs one complete revolution while the chain of rods advances by one step. The cam is made up of three cam elements fixed side by side on the rotary shaft, viz: a first element having a variable radius for determining the shutter opening stage, a second element having a constant radius for determining the degree of maximum opening of the shutter, and a third element having a variable radius for determining the shutter closing stage, the useful length of the common roller being equal to the sum of the thicknesses of the three cam elements. By making the cam elements movable with respect to each other and/or interchangeable, there is a possibility of modifying the modulation of the hot air discharge in accordance with any desired law as a function of the applications considered.

A more complete understanding of the invention will be gained from the following detailed description and from the accompanying drawings in which an improved installation in accordance with the invention for the formation of folds of woven material is shown by way of example and not in any limiting sense, and wherein.

Figure 1:
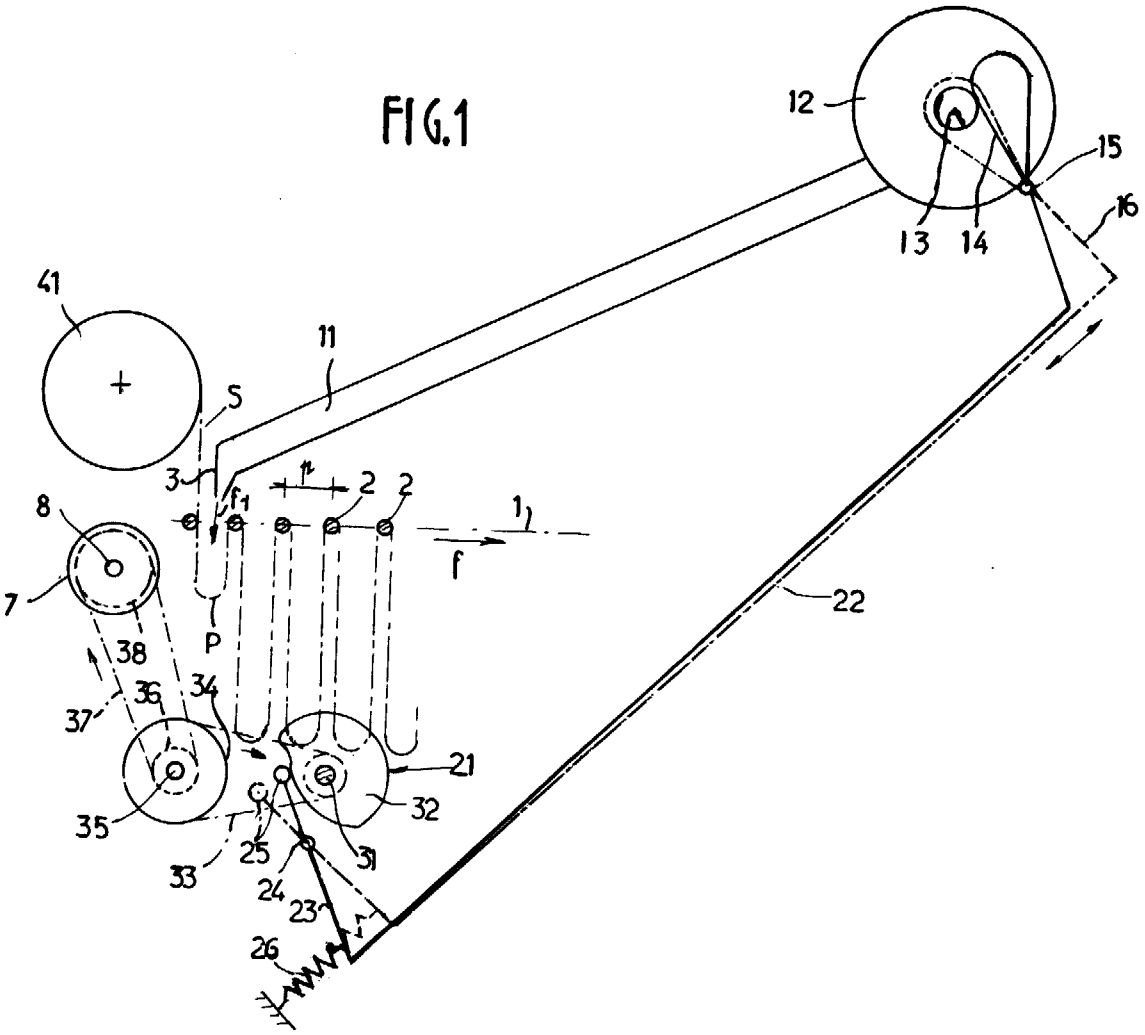
FIG. 1 is a profile view of the complete installation.

The installation shown in FIG. 1 for forming suspended folds of textile strip material as designed for use in a steaming machine comprises a chain 1 of rods 2 spaced at a distance "p" and a nozzle 3 for blowing hot air or steam onto the fold P which is being formed in a strip of textile material 5. The chain 1 passes over a toothed drum 7 which is rigidly fixed on a shaft 8, said shaft being driven by means of a motor (not shown in the drawings). The blowing nozzle 3 is mounted at the downstream end of a duct 11, the upstream end of which is connected to the outlet of a centrifugal fan 12, the central suction inlet 13 of which can be closed more or less completely by means of a shutter 14 pivotally mounted on a pin 15 which is parallel to the axis of the fan. The shutter 14 has an extension in the form of an arm 16 which is actuated from a rotary cam device 21 by means of a drive mechanism comprising: a rod 22 pivoted to the end of the arm 16 and a two-arm lever 23 which is pivotally mounted on a pin 24 and one arm of which is pivoted to the other end of the rod 22 whilst the other arm carries a roller 25 which is continuously urged against the cam 21 under the action of a restoring spring 26. The cam 21 is carried by a shaft 31 which is driven in rotation from the shaft 8 by means of a belt-drive system comprising: a toothed wheel 32 keyed on the shaft 31, a slotted drive belt 33 which passes over the toothed wheel 32, a toothed wheel 34 which is carried by a shaft 35 and over which the slotted drive belt 33 also passes, a toothed wheel 36 which is also keyed on the shaft 35, another slotted drive belt 37 which passes over the toothed wheel 36, and a toothed wheel 38 over which the slotted drive belt 37 also passes. The velocity ratio of the two slotted-belt drive systems 33 and 37 is such that the shaft 31 which carries the cam 21 performs exactly one revolution while the chain 1 advances by one step "p" in the direction of the arrow f, that is to say over a distance equal to the distance between the axes of two successive rods. The textile material 5 to be folded passes over a cylinder 41 which is driven at a much higher circumferential velocity than the speed of forward travel of the chain 1 on which said material is deposited continuously so as to form folds P between two successive rods 2.

Figures 3, 4, 5, 8, 9:
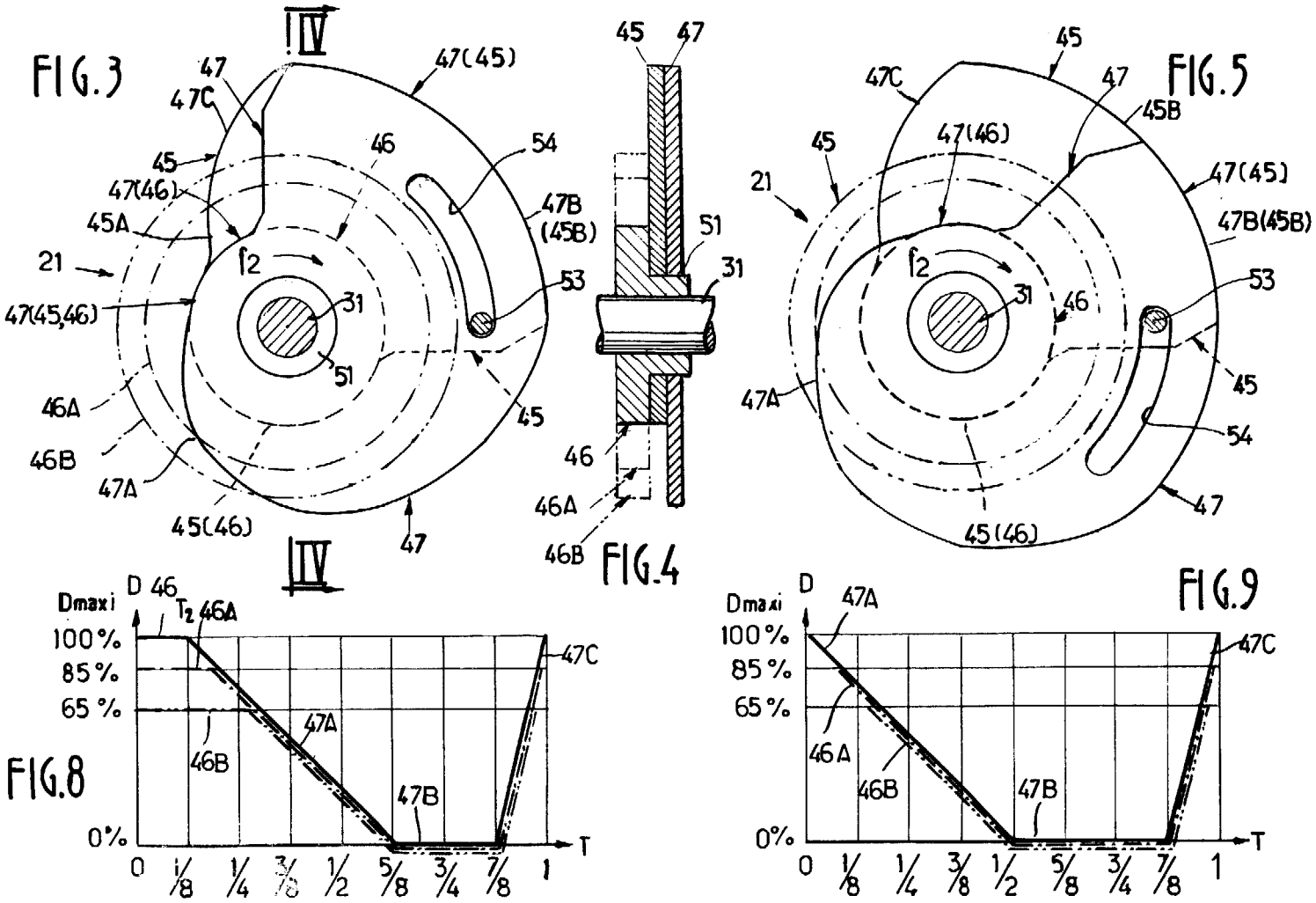
FIGS. 3 and 5 are front views to a larger scale showing the set of cam elements in two positions corresponding to periods during which the shutter remains open.
FIG. 4 is a sectional view of the set of cam elements in the position corresponding to the minimum period during which the shutter remains open, this view being taken along line IV—IV of FIG. 3.
FIGS. 8 to 11 are graphs illustrating the law of displacement of the shutter during one cycle under the action of the sets of cam elements of FIGS. 3, 5, 6 and 7 respectively.

The cam 21 is shown to a larger scale in FIGS. 3 and 4. In actual fact, said cam is constituted by a set of three cam elements, namely: a first element 45 having a variable radius for determining the shutter opening stage, a second element 46 having a constant radius for determining the maximum degree of opening of the shutter, and a third element 47 having a variable radius for determining the shutter closing stage. The cam element 46 is keyed on the shaft 31 and has a hub 51 on which the cam element 45 is rigidly fixed whilst the cam element 57 is capable of pivoting on said hub and can be maintained stationary in any desired angular position with respect to the cam element 45 by means of a screw which is mounted in a corresponding internallythreaded bore of the cam element 47 and which passes freely through an arcuate slot 54 formed in the cam element 47.

In this example, the constant radius of the cam element 46 for determining the maximum degree of opening of the shutter is equal to the common minimum radius of the cam element 45 for determining the shutter opening stage and of the cam element 47 for determining the shutter closing stage. Moreover, the maximum radii of the two cam elements just mentioned are equal and clearly longer than the radius of the circular cam element 46 (having a constant radius). Finally, the roller 25 (shown in FIG. 1) which cooperates with the set 21 of cam elements 45, 46, 47 has a useful length which is equal to the sum of thicknesses of said elements.

Figure 2:
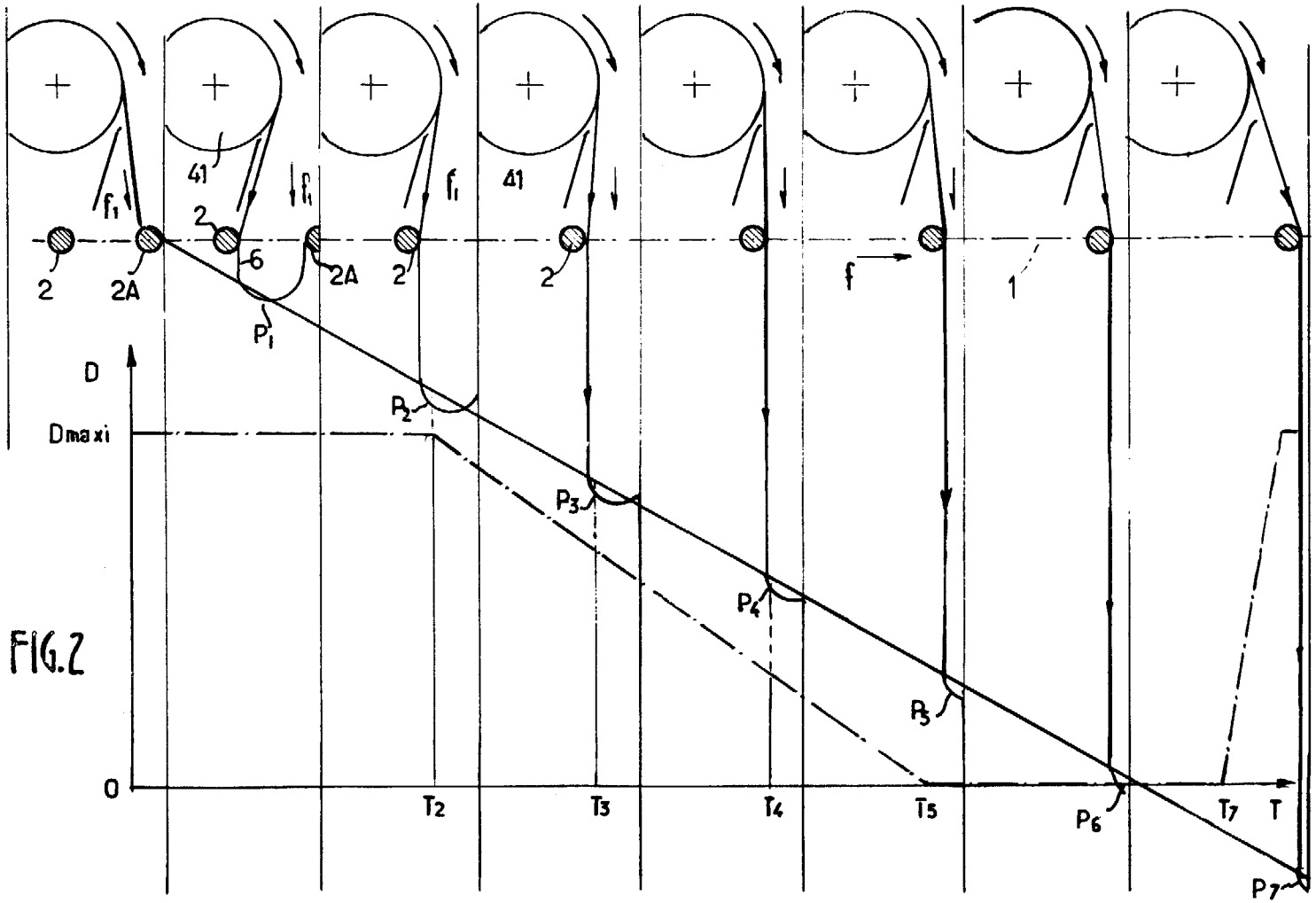
FIG. 2 is a diagram illustrating the values of the nozzle discharge as a function of the state of formation of the fold.

The operation of the installation is as follows:

The cycle begins at the instant at which a rod 2A (as shown in FIG. 2) passes directly beneath the blowing nozzle 3 as represented schematically by the arrow $f_1$ in the different views of FIG. 2 which show the successive stages of formation of a fold in a complete cycle. At this instant, the degree of opening of the shutter is at a maximum, with the result that the discharge of hot air or steam from the nozzle is also at a maximum as indicated at Dmax in the graph of FIG. 2 which is a representation of the successive values of the discharge D as a function of the time interval T and corresponding to the successive representations of the fold P1, P2, P3. . . . . , P7 which are being formed. The discharge flow rate remains at the constant maximum value Dmax and counter-balances the weight of the previous fold until the fold reaches the depth P2 at the instant T2, then decreases while the fold moves downwards successively to the depths P3, P4, P5 respectively at the instants T3, T4, T5. At this instant, the discharge is zero but the fold continues to move downwards to the depths P6 and P7. The discharge begins again only at the instant T7, that is to say just before the next rod 2 appears beneath the blowing nozzle and is very rapidly restored to its maximum value in such a manner as to ensure that the last fold being formed is not subjected to the blowing action at the end of the cycle for as long a period of time as possible. Thus the discharge flow rate is of maximum value (Dmax) at the beginning of the cycle between the instants O and T2, that is to say only during the commencement of formation of the fold, then progressively decreases from the instant T2 to the instant T5 while the fold continues to increase in length. While the fold progresses towards its greatest length P7, that is to say at those moments at which it is the most liable to come into contact with the preceding fold and to stain this latter, said fold is no longer subjected to any blowing action and therefore hangs naturally in a completely vertical direction in spaced relation to the preceding fold.

The general operation of the installation has now been outlined in the foregoing description as illustrated in FIG. 2. The operation of the cams can be understood by referring now to FIGS. 3 and 8 which correspond to a set 21 of cam elements which are adjusted for a maximum shutter opening time. At the beginning of the cycle, the roller is applied against the portion 45A of the cam element 45 and against the circular cam 46. From the instant O to the instant T2, the roller rolls against the circular element 46 and the discharge remains at the maximum value (Dmax or 100%); this stage corresponds to $\frac{1}{8}$ of the time-duration of the cycle. The roller then begins to be thrust back by the portion 47A of the cam element 47 and reduces the flow cross-section left by the shutter in accordance with that portion of the curve which is shown in full lines in FIG. 8 and also designated by the reference 47A. This condition continues up to $\frac{5}{8}$ of the duration of a cycle, at which the discharge has reached a zero value. At this instant, it is the element 47B having a constant maximum radius (sector of a circle) which maintains the roller in a position in which it is thrust back to the maximum extent in order to maintain the shutter in a completely closed position up to $\frac{7}{8}$ of the cycle. At this instant, the portion 47C of the cam element 47 ensures rapid re-opening of the shutter to its maximum degree of opening corresponding to the maximum discharge Dmax which is attained exactly at the end of the cycle.

There wil be noted in FIG. 8 two further curves 46A, 46B which are shown in chain-dotted lines: these curves correspond respectively to two sets of cam elements which have the same two variable-radius elements 45, 47 as the set of FIG. 3 and are keyed angularly in the same manner but in which the circular element 46 has been replaced by an element 46A or 46B (see FIGS. 3 and 4) having longer constant radii so as to reduce the travel of the roller in order that the maximum discharge should only attain 85% or 65% respectively of the value Dmax as is readily apparent from a study of FIG. 8. The other characteristics of the curve remain unchanged.

FIG. 5 shows a set of cam elements which is identical with that of FIG. 3 but is adjusted for a shorter blowing time during commencement of formation of the fold, namely during only one-half of the cycle instead of $\frac{5}{8}$ as is clearly apparent from a study of the full-line curve 47A, 47B, 47C of FIG. 9. The other operating characteristics are the same. The chain-dotted curves 46A, 46B also correspond to those of FIG. 8 but in respect of a shorter blowing time.

Figure 6:
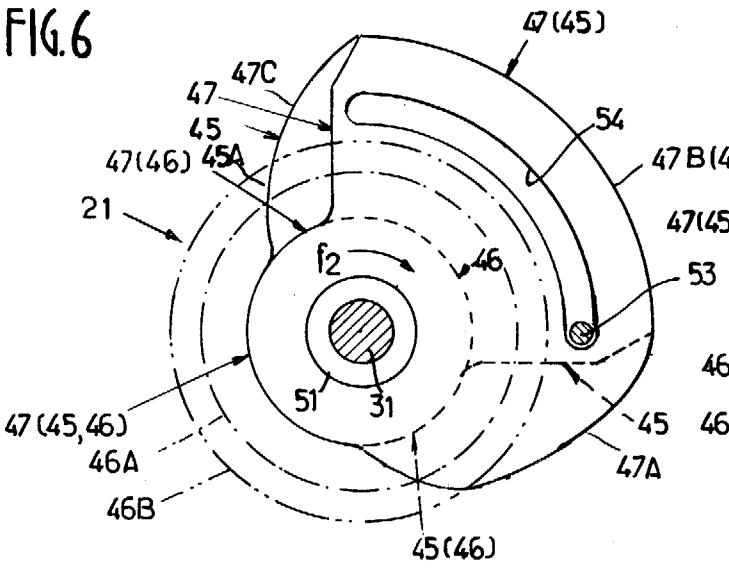

FIG. 6 shows a set of cam elements for ensuring more rapid closure of the shutter. The structure and arrangement of the different cam elements remain the same but the cam element 47A has a steeper slope and therefore a shorter length, and the arcuate slot 54 has been lengthened in order to permit adjustment of the minimum period during which the shutter remains open (as shown in FIG. 7).

Figure 7:
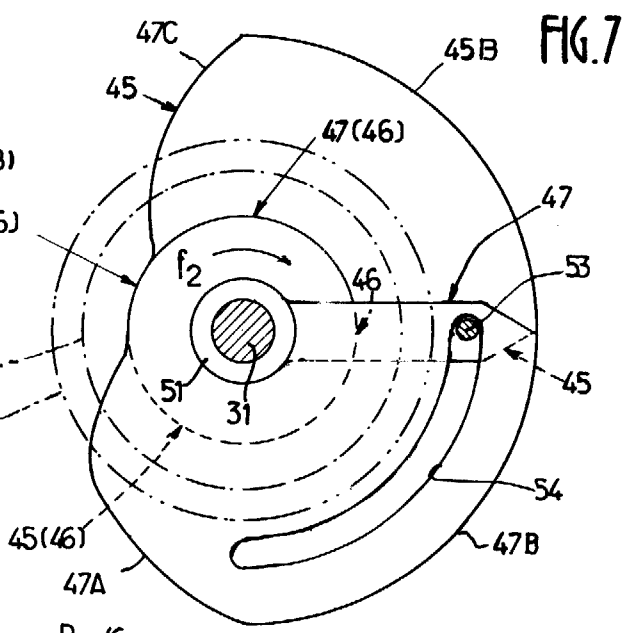
FIGS. 6 and 7 show an alternative embodiment of a set of cam elements for providing a higher rate of variation of the degree of opening of the shutter, respectively in the case of a maximum period and in the case of a minimum period during which the shutter remains open.
Figure 11:
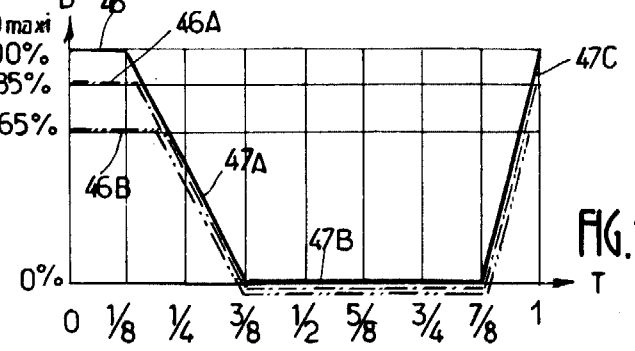
Figure 10:
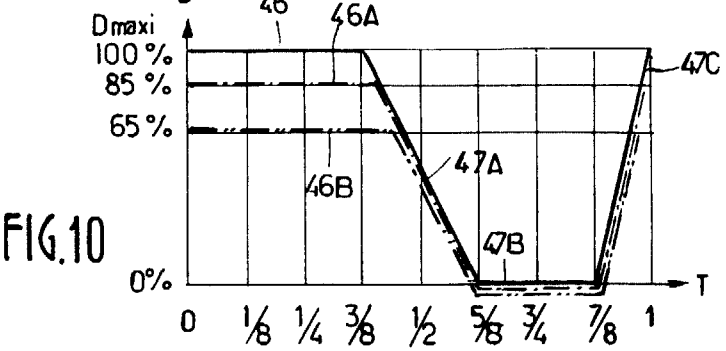

The curves of FIGS. 10 and 11 illustrate the operation of the installation by means of the sets of cam elements shown in FIGS. 6 and 7 respectively: they will not be described in detail but can be readily understood since the reference numerals are the same as those which designate the curves of FIGS. 8 and 9.

It is readily apparent that the invention is not limited in any sense to the embodiments hereinabove described with reference to the accompanying drawings. Many alternative forms of construction within the capacity of anyone versed in the art can accordingly be devised without thereby departing either from the scope or the spirit of the invention.

We claim:

1. An installation for the formation of suspended folds of textile material in strip form comprising, a chain of rods, means for moving said chain of rods horizontally at a low speed, means for continuously depositing at the upstream end of said chain of rods a strip of textile material at a much higher rate than the rate of travel of said chain of rods so as to form suspended folds of material between said rods, a stationary blowing nozzle for directing a jet of steam or hot air onto said upstream end of said chain of rods in order to initiate the formation of each fold between two successive rods of the chain, and a device for cyclic regulation of the discharge of hot air or steam from the nozzle from a predetermined maximum value during commencement of formation of a fold to a zero value after only a fraction of the time required for the formation of a complete fold has elapsed.

2. An installation according to claim 1, wherein means are provided for adjusting the predetermined maximum value of the nozzle discharge during commencement of formation of a fold.

3. An installation according to claim 1, wherein means are provided for adjusting the rate of reduction of the nozzle discharge.

4. An installation according to claim 1, wherein means are provided for regulating the periods of maximum discharge and of zero discharge of the blowing nozzle.

5. An installation according to claim 1, wherein the device for cyclic regulation of the blowing nozzle discharge comprises a movable shutter which is interposed in the fluid circuit for the supply of hot air or steam to the nozzle and which is connected to a roller, said roller being in contact with a cam which is movable in synchronism with the chain of rods.

6. An installation according to claim 5, wherein the cam is carried by a rotary shaft, said shaft being coupled to said means for moving said chain of rods by means of a belt-drive system having a velocity ratio such that said cam shaft performs one complete revolution while the chain of rods advances by one step.

7. An installation according to claim 6, wherein the cam is made up of three cam elements fixed side by side on the rotary shaft, namely a first element having a variable radius for determining the shutter opening stage, a second element having a constant radius for determining the degree of maximum opening of the shutter, and a third element having a variable radius for determining the shutter closing stage, the useful length of the roller being equal to the sum of the thicknesses of the three cam elements which are juxtaposed on said rotary shaft.

8. An installation according to claim 7, including means whereby the first and third cam elements can be angularly displaced with respect to each other so as to permit adjustment of the periods during which the shutter is open or closed during one cycle.

9. An installation according to claim 7, wherein at least one of the cam elements is interchangeable so as to be replaced by another cam element having different characteristics.

* * * * *